US010495385B2

(12) United States Patent
Grande Fernández et al.

(10) Patent No.: US 10,495,385 B2
(45) Date of Patent: Dec. 3, 2019

(54) HEAT EXCHANGE DEVICE

(71) Applicant: BORGWARNER EMISSIONS SYSTEMS SPAIN, S.L.U., Vigo, Pontevedra (ES)

(72) Inventors: José Antonio Grande Fernández, Pontevedra (ES); Germán Troncoso, Pontevedra (ES)

(73) Assignee: Borgwarner Emissions Systems Spain, S.L.U., Vigo, Pontevedra (ES)

( * ) Notice: Subject to any disclaimer, the term of this patent is extended or adjusted under 35 U.S.C. 154(b) by 352 days.

(21) Appl. No.: 15/133,035

(22) Filed: Apr. 19, 2016

(65) Prior Publication Data

US 2016/0305713 A1 Oct. 20, 2016

(30) Foreign Application Priority Data

Apr. 20, 2015 (EP) ..... 15382190

(51) Int. Cl.
*F28F 9/02* (2006.01)
*F02M 26/32* (2016.01)
(Continued)

(52) U.S. Cl.
CPC ..... *F28D 7/1638* (2013.01); *F28F 9/0221* (2013.01); *F28F 9/0236* (2013.01);
(Continued)

(58) Field of Classification Search
CPC .... F28D 7/1646; F28D 7/1661; F28D 7/1692; F28D 21/0003; F28F 9/0131;
(Continued)

(56) References Cited

U.S. PATENT DOCUMENTS 1,376,135 A * 4/1921 Braun ..... F28D 7/1646 165/78
3,603,383 A * 9/1971 Michael ..... F28F 9/0239 165/158
(Continued)

FOREIGN PATENT DOCUMENTS

CN 101093153 A 12/2007
CN 102619648 A 8/2012
(Continued)

OTHER PUBLICATIONS

Extended European Search Report for European Application No. 1615749.9 dated Jul. 8, 2016.
(Continued)

*Primary Examiner* — Leonard R Leo
(74) *Attorney, Agent, or Firm* — Jenkins, Wilson, Taylor & Hunt, P.A.

(57) ABSTRACT

A heat exchange device of a floating core type, having a special configuration which allows increasing its durability as it increases its thermal fatigue resistance. The device is characterized by a configuration having high thermal fatigue resistance due to the special configuration of the end where the floating side of the core is located since stagnation regions that are usually produced in the baffle of the floating end are eliminated by the combination of the shape of the shell and of a deflector. This configuration furthermore results in a low-cost exchanger.

16 Claims, 8 Drawing Sheets

(51) Int. Cl.
*F28D 7/16* (2006.01)
*F28D 21/00* (2006.01)

(52) U.S. Cl.
CPC ..... *F28F 9/0241* (2013.01); *F02M 26/32* (2016.02); *F28D 7/1653* (2013.01); *F28D 21/0003* (2013.01); *F28F 9/0219* (2013.01); *F28F 9/0239* (2013.01); *F28F 2265/26* (2013.01)

(58) Field of Classification Search
CPC ..... F28F 9/0239; F28F 9/0219; F28F 9/0221; F28F 9/0236; F28F 9/0241; F02M 26/32
USPC ..... 165/83, 159
See application file for complete search history.

(56) References Cited

U.S. PATENT DOCUMENTS 3,822,741 A * 7/1974 Lippitsch ..... F28F 9/00 165/83
4,653,575 A * 3/1987 Courchesne ..... F24F 13/30 165/159
4,907,643 A * 3/1990 Grotz ..... F28F 9/0219 165/134.1
6,874,572 B2 * 4/2005 Wanni ..... F28F 9/0137 165/162
8,033,323 B2 10/2011 Schatz et al.
8,240,367 B2 * 8/2012 Wanni ..... F28D 9/0075 165/174
8,720,199 B2 5/2014 Gaensler et al.
9,157,397 B2 10/2015 Zhang et al.
9,279,395 B2 3/2016 Lorenz et al.
2014/0034028 A1 2/2014 Zhang et al.
2014/0090804 A1 * 4/2014 Samz ..... F28F 9/0239 165/81
2014/0124179 A1 * 5/2014 Sanz ..... F28D 7/1623 165/157

FOREIGN PATENT DOCUMENTS

CN 102721301 A 10/2012
CN 103703238 A 4/2014
DE 10312788 A1 9/2004
DE 102006042936 A1 3/2008
EP 2522845 A1 11/2012
EP 2728155 A1 5/2014
FR 2358631 A1 2/1978
JP S61256193 A 11/1986

OTHER PUBLICATIONS

First Office Action and First Search for Chinese Application No. 201610248996.7 dated May 4, 2018.
Chinese Office Action for Application No. 201610248996.7 dated Apr. 3, 2019.

* cited by examiner

HEAT EXCHANGE DEVICE

CROSS-REFERENCE TO RELATED APPLICATION

This application claims the benefit of and priority to European patent application No. 15382190.5 filed on Apr. 20, 2015, the entire disclosure of which is incorporated by reference herein.

TECHNICAL FIELD

The present disclosure relates to a heat exchange device of the so-called floating core type, having a special configuration which allows increasing its durability as it increases its thermal fatigue resistance.

This disclosure herein is characterized by a configuration having high thermal fatigue resistance due to the special configuration of the end where the floating side of the core is located since stagnation regions that are usually produced in the baffle of the floating end are eliminated by the combination of the shape of the shell and of a deflector. This configuration furthermore results in a low-cost exchanger.

The device can be applied in EGR (Exhaust Gas Recirculation) systems the use of which in internal combustion engines reduces the emission of contaminant gases, thus protecting the environment.

BACKGROUND

One of the technical fields undergoing the most intensive development is the field of EGR system heat exchangers since the space and packaging requirements call for increasingly smaller and more efficient devices to allow discharging the same amount of heat in a smaller space.

When devices are smaller, the same temperature differences are found between areas located closer to one another and therefore result in higher temperature gradients.

Additionally, heat exchangers formed by a shell housing a bundle of exchange tubes where this bundle of tubes extends between two baffles have the drawback of differential expansion occurring between the shell, directly in contact with the coolant liquid, and in the bundle of tubes, also in direct contact with the hot gas to be cooled. Differential expansion between one component and another is particularly pronounced in the longitudinal direction established by the main direction along which the bundle of tubes extends.

Among the technical solutions known for preventing differential expansion between the shell and bundle of tubes from giving rise to stresses causing breaks are those based on floating core configurations. The core is the bundle of heat exchange tubes where the tubes are attached at least between two end baffles. One baffle is conjoint with the shell and the other baffle, i.e., the baffle corresponding to the floating end, allows relative movement with respect to the shell. The baffle that allows movement is usually connected, according to the particular configuration of the exchanger, by an elastically deformable element establishing the fluid continuity of the hot gas conduit and it is the one which allows thermal expansion.

Both fixed and movable baffles are walls located transverse to the bundle of tubes. If the hot gas inlet is at the floating end, the movable baffle is the one that is subjected to higher temperature. Given that the baffle is movable, the coolant liquid flow tends to flow around the perimetral area of the baffle. This condition leads to a stagnation point or region causing the coolant liquid to remain in the hot area without discharging heat until reaching the boiling temperature. This is one of the causes generating thermal fatigue and failure of the device.

The present disclosure proposes a particular configuration of a floating core device in which the existence of stagnation regions in the baffle on the floating side is prevented, preventing thermal fatigue and therefore prolonging the service life of the device.

SUMMARY

The present disclosure relates to a heat exchange device adapted for cooling a hot gas by a coolant liquid, particularly configured for preventing thermal fatigue, solving the drawbacks identified above.

The device comprises:

- a bundle of heat exchange tubes extending according to a longitudinal direction X-X' between a first fixed baffle and a second floating baffle for passage of the hot gas to be cooled,
- a shell housing the bundle of tubes wherein the space between the shell and the bundle of tubes allows passage of the coolant liquid, wherein:
  - the shell is closed at one end by the first fixed baffle and comprises at the opposite end a chamber configured by an extension by a shell segment having a larger cross-section closed with a third baffle,
  - a first coolant liquid inlet/outlet is located at a point of the shell on the side of the first baffle and a second coolant liquid inlet/outlet is established in a position of the shell segment having a larger cross-section.

The heat exchanger has a floating core configuration. The core is formed by a bundle of exchange tubes extending between two baffles, a first baffle which is conjoint with the shell, hence it is referred to as a fixed baffle, and a second floating or movable baffle due to the effect of differential expansion with respect to the shell. The expansion compensated for by the floating core configuration is the expansion in the direction of the exchange tubes. This is the direction identified as longitudinal direction X-X'. The baffles are usually arranged transverse to the longitudinal direction.

The exchange tubes are tubes through which the hot gas to be cooled passes, and they are externally surrounded by the coolant liquid. The coolant liquid circulates through the space located between the outer surface of the tubes of the bundle of tubes and the shell.

The shell also extends according to longitudinal direction X-X'. It is closed at one end by the fixed baffle. The shell comprises at the opposite end an extension configured by a segment located at the end opposite the end containing the fixed baffle and the section of which is larger. The larger section of this end segment forms a chamber. The final end of the shell on the side of the chamber formed by the segment having a larger section is closed by a third baffle. One particular way of providing the extension is by two tubular bodies having different sections, i.e., a first tubular body having a smaller section, housing primarily the bundle of tubes, and a second tubular body having larger dimensions located right after the end of the first tubular body. The transition between the first tubular body and the second tubular body can be configured by a transition body formed by a transition surface between the section of the first tubular body and the section of the second tubular body. This transition surface establishes continuity between the first body and the second body assuring leaktightness between them. If the tubular bodies have a circular section, the transition surface can be ring-shaped or even funnel-shaped.

The heat exchanger can operate under co-current or counter-current flow. Therefore, accesses to the inner space of the shell intended for the coolant liquid are identified as inlet/outlet. There are at least two accesses for the entry and exit of the coolant liquid, a first access located at a point of the shell on the side of the first baffle, i.e., close to the first baffle, and the other access is located on the opposite side located in a position of the shell segment having a larger section. If one of the accesses serves as an inlet then the other one is the outlet.

Additionally, the device provides that:

the second floating baffle has a manifold in fluid connection with the inlet of the heat exchange tubes, and the manifold is in turn in fluid connection with an inlet for the hot gas arranged in the third baffle, where this fluid connection is by an elastically deformable conduit at least according to longitudinal direction X-X', the second floating baffle together with the manifold are housed in the extension formed by the shell segment having a larger section and spaced by a separation from the shell segment along the perimeter of the assembly to allow passage of the coolant liquid; and the position of the shell segment having a larger section where the second coolant liquid inlet/outlet is located, according to the longitudinal direction, between the second floating baffle-manifold assembly and the third baffle.

The second baffle or floating baffle of the bundle of tubes is therefore located between the first baffle and the third baffle in a position such that it is housed in the chamber formed by the extension of the shell. Enlargement in longitudinal direction X-X' is mainly due to the longitudinal expansion of the bundle of tubes so the assembly formed by the second baffle and the manifold distributing hot gas at the inlet of the exchange tubes of the bundle of tubes will move inside this chamber. The longitudinal expansion of the entire core establishes a degree of approaching the third baffle and is compensated for by the deformation capability of the elastically deformable conduit connecting the hot gas inlet of the heat exchanger and the manifold.

Hot gas therefore enters through an opening of the third baffle and gains access to the manifold through the elastically deformable conduit. The inside of the manifold is in fluid communication with the inside of the exchange tubes such that the hot gas is distributed for passing inside the exchange tubes of the bundle of tubes. In the passage through the exchange tubes, the hot gas transfers its heat to the coolant liquid and reaches the opposite end of the tubes, i.e., the end located in the first baffle. The cooled gas is collected, for example, by another outer manifold, and used for final use thereof as an EGR gas, for example.

With respect to the inner configuration of the exchanger, it is additionally verified that:

in the perimetral separation between the second floating baffle-manifold assembly and the shell segment having a larger section there is a deflector closing the separation space between the assembly and the shell segment having a larger section at least along a segment of the perimetral separation.

This configuration primarily affects coolant flow. As indicated above, the heat exchanger can operate under co-current or counter-current flow.

For example, when the heat exchanger operates under counter-current flow and gas enters on the side of the floating core, the coolant liquid enters the shell on the fixed side of the core and flows towards the second baffle. In this segment, the flow is guided by the shell segment that does not correspond to the extension and is therefore arranged against the exchange tubes since reducing the space between the exchange tubes and the shell reduces the presence of paths having lower resistance which favor preventing flow passage between the exchange tubes, reducing the effectiveness thereof.

This flow reaches the second baffle which is located, together with the manifold, in the chamber formed by the extension of the shell. Given that this assembly formed by the second floating baffle-manifold is spaced by a separation space with the inner wall of the shell segment having a larger section surrounding them, the flow following a longitudinal direction tends to flow around the baffle in order to pass through the perimetral space.

If there were no additional element, the streamlines corresponding to this flow would extend longitudinally and, upon reaching the baffle, they would get around it through any of the points in the periphery thereof. If, for example, the baffle has a rectangular configuration and four sides, there is a stagnation point with this configuration corresponding to the lines that do not lead to any of the four sides. If, for example, the baffle is circular, then the stagnation point would be the central area of the baffle since the flow lines would not have a preferred position in the periphery for getting around the second baffle.

The disclosure herein prevents this stagnation region by including a deflector closing the separation space between the assembly formed by the floating baffle together with the manifold and the extended segment of the shell. This deflector closes the space at least along a perimetral segment. In the counter-current example that is being described, the deflector is located downstream with respect to the second baffle.

The purpose of this deflector is to prevent the passage of most of the flow lines therethrough allowing only the passage through a perimetral portion of the deflector. Additionally, with this deflector it has been observed that the trajectory of the streamlines located on the side of the second baffle in contact with the coolant liquid is modified because a velocity field parallel to the second baffle is created, minimizing and even eliminating stagnation points. Stagnation points are eliminated by a sweeping effect due to a flow parallel to the baffle identified with the streamlines essentially parallel to the baffle in the proximity thereof. This has the effect of increasing coolant velocity with respect to the hot baffle, i.e., the second baffle, significantly increasing the level of cooling thereof and therefore reducing thermal stresses therein.

In this same counter-current configuration, the effect of generating a velocity field parallel to the second baffle is upstream of the position of the deflector, whereas under co-current flow, the effect is the same and occurs downstream of the deflector. By numerical flow simulation experiments in both cases, the same technical effect is observed, though somewhat greater when the device operates under counter-current flow.

Likewise, tests have been conducted with prototypes which, without the deflector, failed due to thermal fatigue with a reduced number of cycles, and where the service life of the same device with this deflector has increased such that the fatigue experiment had to be stopped due to its duration without any failure occurring.

Several additional technical solutions have been developed for the disclosure herein and are described in the embodiment described below.

BRIEF DESCRIPTION OF THE DRAWINGS

The foregoing and other features and advantages of the disclosure herein will be more clearly understood based on the following detailed description of a preferred embodiment provided only by way of illustrative and non-limiting example in reference to the attached drawings.

DETAILED DESCRIPTION

According to the first inventive aspect, the present disclosure relates to a heat exchange device adapted for cooling a hot gas by a coolant liquid. One of the uses of this exchanger is to cool part of the combustion gases produced by an internal combustion engine in order to reintroduce them in the intake forming part of an EGR system.

Figure 1:
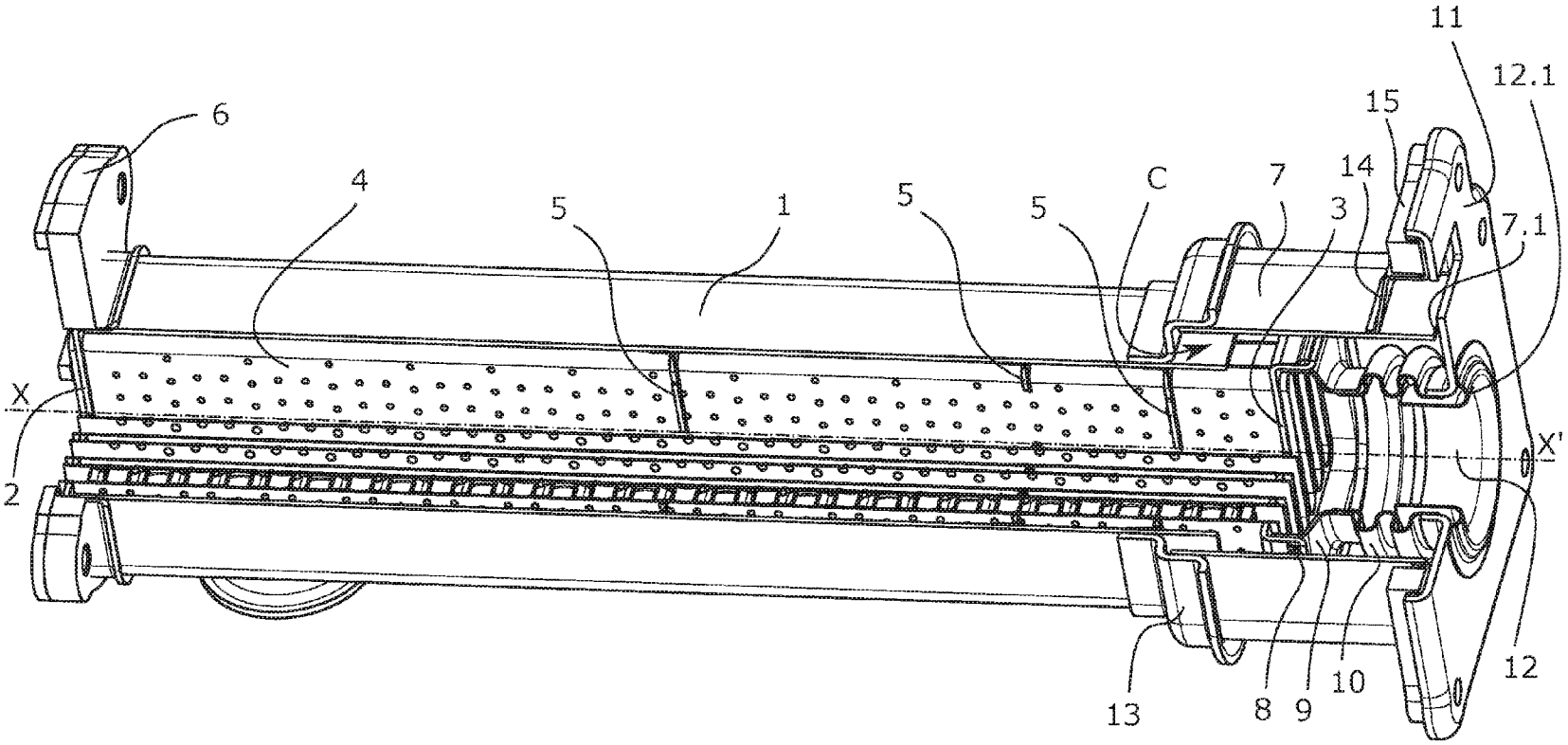
FIG. 1 shows one embodiment of the disclosure herein formed by a heat exchanger having a rectangular section configuration. The drawing shows a perspective quarter-section view of the heat exchanger along the entire length to allow observing the inner structure.

FIG. 1 shows one embodiment of the disclosure herein, a heat exchanger with a floating core configuration formed by a shell (1) in which, in this embodiment, the section of the shell (1) is essentially rectangular. The fixed side of the exchanger is shown on the left side of FIG. 1, fixed being understood as the core of the exchanger being conjoint with the shell, and the side where the core is floating and allows thermal expansion in longitudinal direction X-X' is shown on the right side.

The exchanger of the embodiment has on the fixed side a fixing flange (6) which allows screwing the exchanger, for example, to a manifold not depicted in the drawing for the sake of clarity, which manifold receives the outlet gases from the exchanger once they have been cooled.

In this embodiment, the heat exchanger has a bundle of tubes (4) extending from a first baffle (2) conjoint with the shell (1) to a second floating baffle (3), i.e., not conjoint with the shell (1).

In this embodiment, the first baffle has dimensions greater than the section of the shell (1) such that the flange (6) presses this first baffle (2), for example, against a second flange of the manifold that is not shown.

The bundle of tubes (4) has a plurality of support baffles (5) distributed along the length thereof that are either conjoint with the shell (1) and without restricting longitudinal movement of the bundle of tubes (4) passing therethrough or conjoint with the bundle of tubes (4) passing therethrough and without restricting longitudinal movement with respect to the shell (1). In any of the embodiments of the support baffles (5), the generation of stresses due to differential expansion of the exchange tubes (4) with respect to the shell (1) is prevented. The support action of these support baffles (5) is with respect to the transverse direction, for example, preventing inertial effects due to mechanical vibrations, and it also establishes a flow with transverse components increasing heat exchange between the bundle of tubes (4) and the coolant liquid circulating inside the shell (1).

In the embodiment shown in this example, the exchange tubes are hybrid tubes, i.e., having an essentially planar configuration and containing therein a bent plate forming fins increasing the effective exchange surface to facilitate heat transfer from the hot gas to the coolant liquid covering the outside of the exchange tubes (4). Nevertheless, it is possible to use another tube configuration without modifying the essential features of the disclosure herein.

The floating end of the heat exchanger shows an extension of the shell (1). In this embodiment, the extension is achieved using two tubular bodies, a first tubular body (1) arranged against the bundle of tubes (4) where one of the ends is the side conjoint with the first baffle (2), and a second tubular body, a shell segment (7) having a larger section, making up the end segment located at the opposite end of the exchanger according to longitudinal direction X-X'.

In this embodiment, the first tubular body of the shell (1) and the second tubular body, the shell segment (7) having a larger section, are attached by a transition part (13) configured by a deep-drawn and die-cut plate. This transition part (13) receives the first tubular body of the shell (1) on one side and receives the shell segment (7) having a larger section on the opposite side, such that this transition part defines the extension region of the first tubular body of the shell (1).

The second baffle (3) is located at the floating end of the bundle of tubes (4). The exchange tubes of the bundle of tubes (4) are attached to this second baffle (3) and this second baffle (3) is in turn attached to a manifold (9) which is in communication with the hot gas inlet.

The manifold (9) receives incoming hot gases and distributes the gas through the inlets of the exchange tubes (4) such that the hot gas is forced to enter the exchange tubes (4).

In this embodiment, the second baffle (3) is configured by a die-cut and stamped plate surrounding the manifold (9) where the contact area between both parts (3, 9) is an attachment by brazing.

The manifold (9) is connected with the end of the exchanger on the floating side by an elastically deformable conduit (10). In this embodiment, the elastically deformable element (10) is a bellow-shaped metal conduit. The closure of the shell at the floating end where the shell segment (7) formed by a tubular body having a larger section is located, is established by a third baffle (11) having the hot gas inlet.

The assembly formed by the second baffle (3) and the manifold (9) are housed in the shell segment (7) having a larger section.

A coolant liquid inlet/outlet is located at the end of the shell corresponding to the fixed side and the other inlet/outlet is located at the opposite end. In this embodiment, the coolant inlet/outlet of the floating side is configured by a groove (7.1) arranged between the end of the shell segment (7) having a larger section and the third baffle (11). This configuration has several technical effects, the first being that of placing this groove (7.1) in the area adjacent to the wall formed by the third baffle (11), preventing stagnation areas between the inlet/outlet and the third baffle (11), and the second being that of placing same in an area close to the elastically deformable conduit (10), favoring cooling thereof.

The elastically deformable conduit (10) is what receives the hot gas in a more direct manner when the heat exchanger is operating such that this part (10) is the part having a higher temperature. The end position of the coolant inlet/outlet favors the entire length of this elastically deformable conduit (10) being suitably cooled, preventing device failure in this location.

In this embodiment, the second baffle (3) and the manifold (9) also have a rectangular configuration. There is arranged between both components (3, 9) and the shell segment (7) having a larger section a space allowing passage of the coolant liquid since the inlet/outlet is located adjacent to the third baffle (3).

Streamlines extend primarily from the space between the tubes of the bundle of tubes (4) to the chamber (C), formed by the extension of the shell segment (7) having a larger section, surrounding the assembly formed by the second baffle (3) and the manifold (9). These streamlines would contain one or more streamlines that would end in the second baffle, giving rise to a stagnation region were it not for the presence of a deflector (8) located between the assembly formed by the second baffle (3) and the manifold (9), and the shell segment (7) having a larger section. This deflector (8) modifies the configuration of streamlines, preventing the symmetry that makes the streamlines tend to surround the entire second baffle (3).

In particular, in this embodiment the deflector (8) extends perimetrally around the assembly formed by the second baffle (3) and the manifold (9) in a segment equivalent to three of the four sides of the rectangular configuration of the second baffle (3) or with respect to the respective four sides of the rectangular configuration of the shell segment (7) having a larger section with which it establishes the closure.

The flow is therefore forced to only pass through one of the sides, making this preferred direction cause streamlines to run parallel to the second baffle (3), preventing stagnation regions.

In this embodiment, closure on three of the four sides by a deflector (8) is established around the group formed by the second baffle (3)-manifold (9) assembly in a perimetral band spaced from the plane defined by the second baffle (3) in longitudinal direction X-X' towards the side opposite the fixed end of the heat exchanger.

Figure 2:
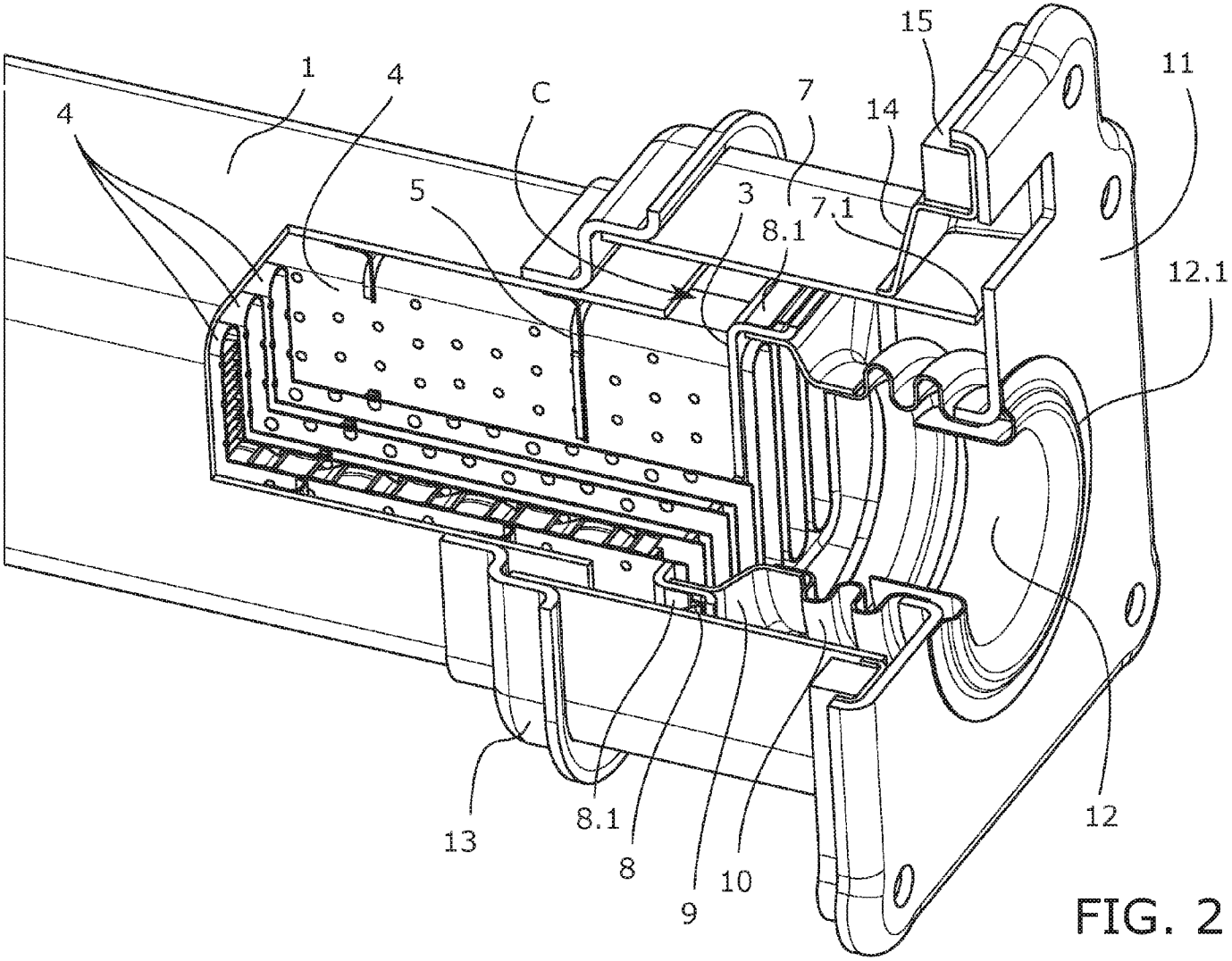
FIG. 2 shows the same embodiment where now only the end corresponding to the floating side is shown and the selected view is a perspective quarter-section view of the segment having a length corresponding to the chamber where the segment having a larger section of the shell is located.

It is observed in FIG. 2, with greater detail on the floating side, that in the section of the drawing corresponding to the horizontal plane of section, the deflector (8) sits on the second baffle (3) and presses against the inner wall of the shell segment (7) having a larger section. Nevertheless, in the section of the drawing corresponding to the vertical plane of section, it is observed that the deflector (8) sits on the second baffle (3) but does not extend to the inner wall of the shell segment (7) having a larger section to allow passage of the coolant liquid. Passage of the coolant liquid according to this FIG. 2 is in the upper part of the drawing in order to observe the difference between the side closure and this opening.

Figure 3:
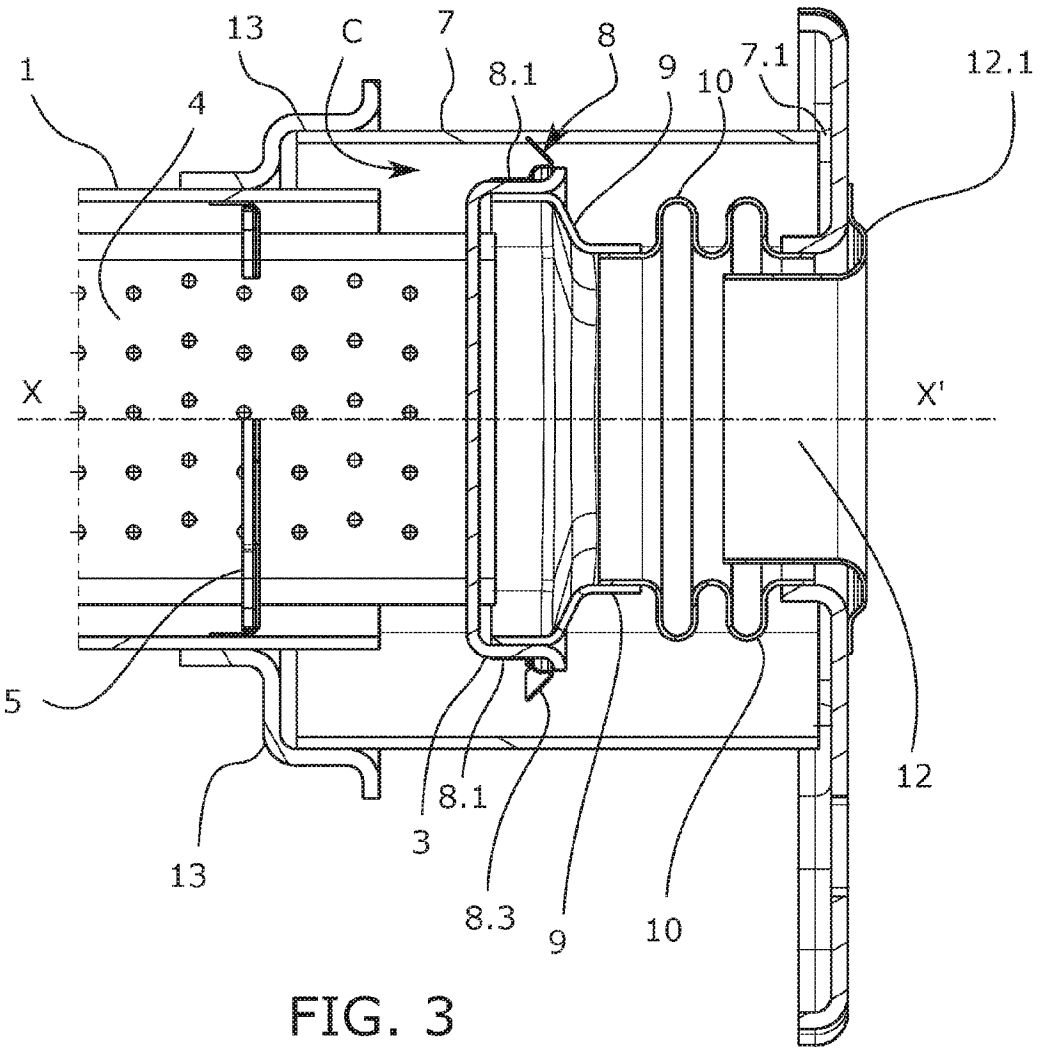
FIG. 3 shows the same end of the embodiment of the preceding figure where the section is according to a longitudinal plane passing through the center of the device.
Figure 4:
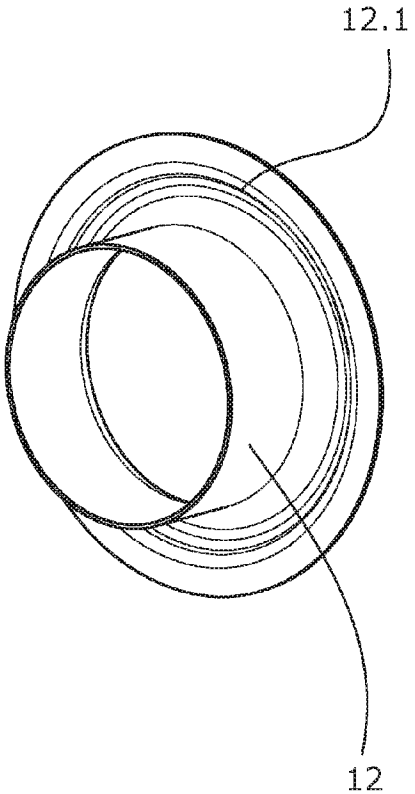
FIG. 4 shows a perspective view of an intake deflector protecting the elastically deformable conduit, among others.

Nevertheless, in the section of FIG. 3, the open side is located in the lower part, rotating the device 180° with respect to the X-X' axis.

Figure 5:
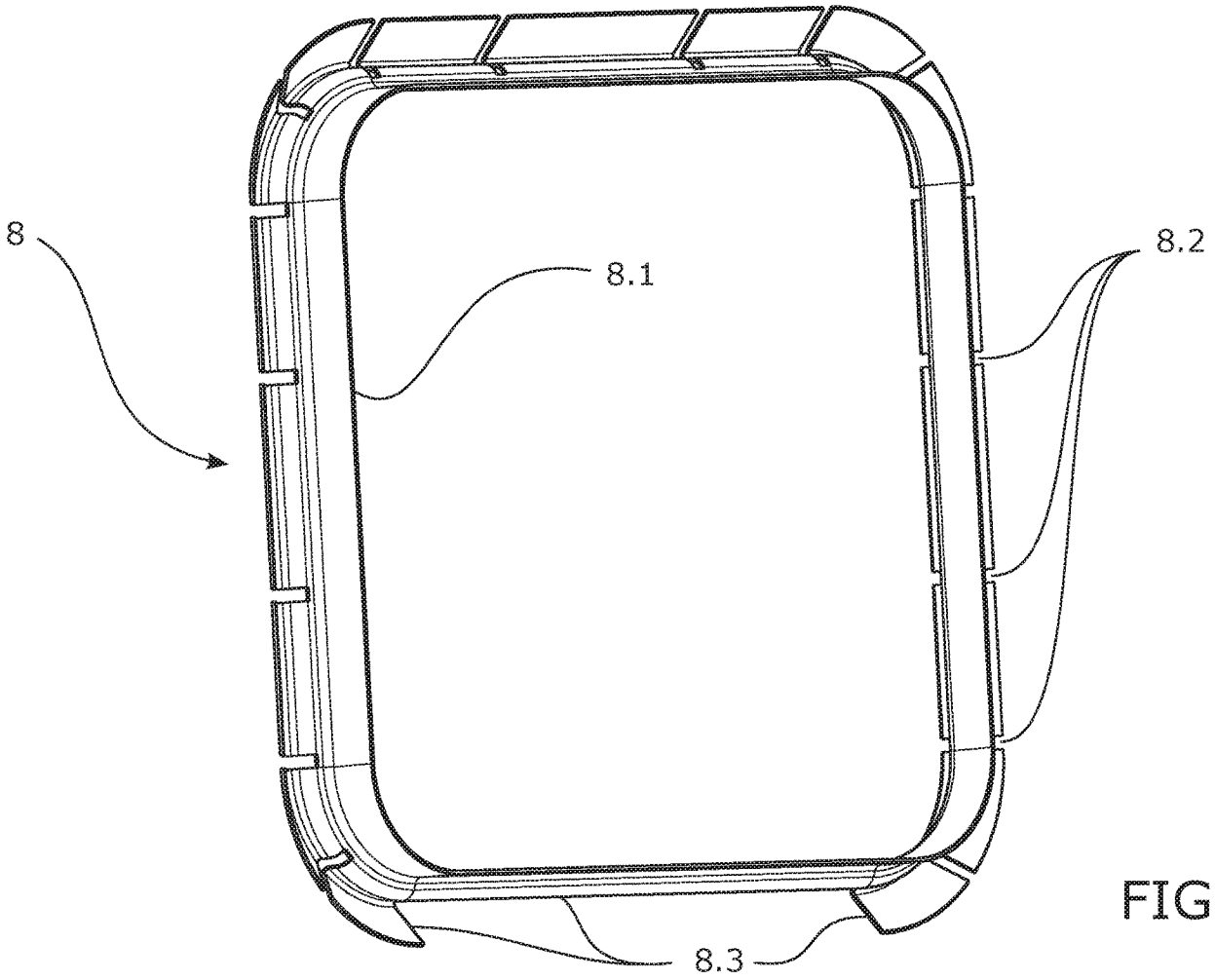
FIG. 5 shows a perspective view of the deflector.

FIG. 5 shows a perspective view of the deflector (8) used in this embodiment in an essentially rectangular shape, configured for surrounding the second baffle (3) and the latter in turn surrounding the manifold (9).

The deflector (8) is manufactured from die-cut and bent plate. It internally has a perimetral band giving rise to the seat (8.1) which is supported on the surface of the second baffle (3). Perimetrally, the perimetral surface is formed by consecutively arranged sheets to prevent passage and to give rise to flexible elements that are arranged against the inner wall of the shell segment (7) having a larger section. These sheets are distributed perimetrally except on one side, in this case a smaller side, giving rise to a window (8.3) for passage of the coolant liquid.

There are also small separations (8.2) between sheets which allow a small amount of coolant flow. Passage of this small amount of flow through the separations prevents new stagnation regions from being generated around the deflector (8).

It has been found through experiments that this arrangement and configuration of the deflector (8) located in the chamber (C) prevents stagnation regions in the second baffle (3) which is in contact with the hottest gas since these same experiments demonstrate that the described configuration generates a flow parallel to the second baffle (3) entraining any stagnation region, increasing coolant velocity in the area closest to the wall of the metal and therefore preventing thermal fatigue.

Blocking of the flow by the deflector (8), like any other surface placed in the way of a flow, generates stagnation regions, precisely the effect to be prevented. Nevertheless, the configuration by sheets distributed with separations (8.2) prevents the formation of these stagnation or recirculation regions without preventing the sweeping effect of the stagnation regions from occurring in the second baffle (3).

This change in configuration of streamlines in the coolant flow has been verified by numerical CFD simulations both under co-current and counter-current flow.

Thermal fatigue test results have also demonstrated that failures which occur without using the deflector (8) disappear.

Another technical solution adopted in this embodiment is the existence of a prolongation of the first tubular body of the shell (1) entering part of the chamber (C) formed by the shell segment (7) having a larger section. In this case, the velocity of the velocity field in the chamber (C) and particularly the transverse flow running parallel to the second baffle (3) is increased. The technical effect is better cooling of the second baffle (3), i.e., the baffle exposed to hot gas the most. The increase in velocity is also observed inside the chamber (C) and therefore reduces new stagnation points generated by the deflector (8).

The embodiment of the disclosure herein also incorporates another way to additionally protect the elastically deformable conduit (10) from the high temperatures to which it is subjected given that the conduit directly receives the incoming hot gas. The way to protect the inlet is by an intake deflector (12) configured by a tubular segment intended for being housed inside the elastically deformable conduit (10) but spaced from it. The separation between the elastically deformable conduit (10) and the intake deflector (12) establishes a chamber insulating the elastically deformable conduit (10), reducing direct heat transfer from the hot gas flow. Not only does it establish a separation chamber but it also establishes guidance of the hot gas flow towards the central axis so that it does not hit the walls directly.

The tubular segment of the intake deflector (12) expands outwardly in order to be supported on the outer surface of the third baffle (11). This configuration allows the third baffle (11), once it is attached to an outer flange, to leave this outer extension of the intake deflector (12) retained, achieving the fixing thereof. This fixing does not require welding which, with abrupt temperature changes, would be damaged by the expansion stresses that would be produced.

Additionally, this intake deflector (12) shows a perimetral rib (12.1) in the extension, which is achieved in this embodiment by deep-drawing, increasing the pressure with which the third baffle (11) and the outer flange are fixed. Particularly, the perimetral rib (12.1) is located on the outer face of the third baffle (11) for establishing a pressure type seat after establishing the attachment of the flange.

The section of FIGS. 1 and 2 shows the groove (7.1) of the coolant liquid inlet/outlet obtained by the spacing of the end edge of the shell segment (7) having a larger section with the third baffle (3). A coolant liquid manifold (14) for receiving/supplying coolant liquid since the coolant liquid manifold (14) is in fluid communication with the groove (7.1) is formed in this embodiment by a die-cut outer plate.

The die-cut outer plate giving rise to the coolant liquid manifold (14) runs parallel to the outer edge of the third baffle (11), such that together with a flange (15) having greater resistance, the means of fixing with the outer flange which is not graphically depicted are defined.

The outer face of the third baffle (3) together with the perimetral rib (12.1) of the intake deflector (12) is the seat with which the heat exchanger is attached on the hot side to the outer flange connecting the heat exchanger with the hot gas uptake.

Figure 6:
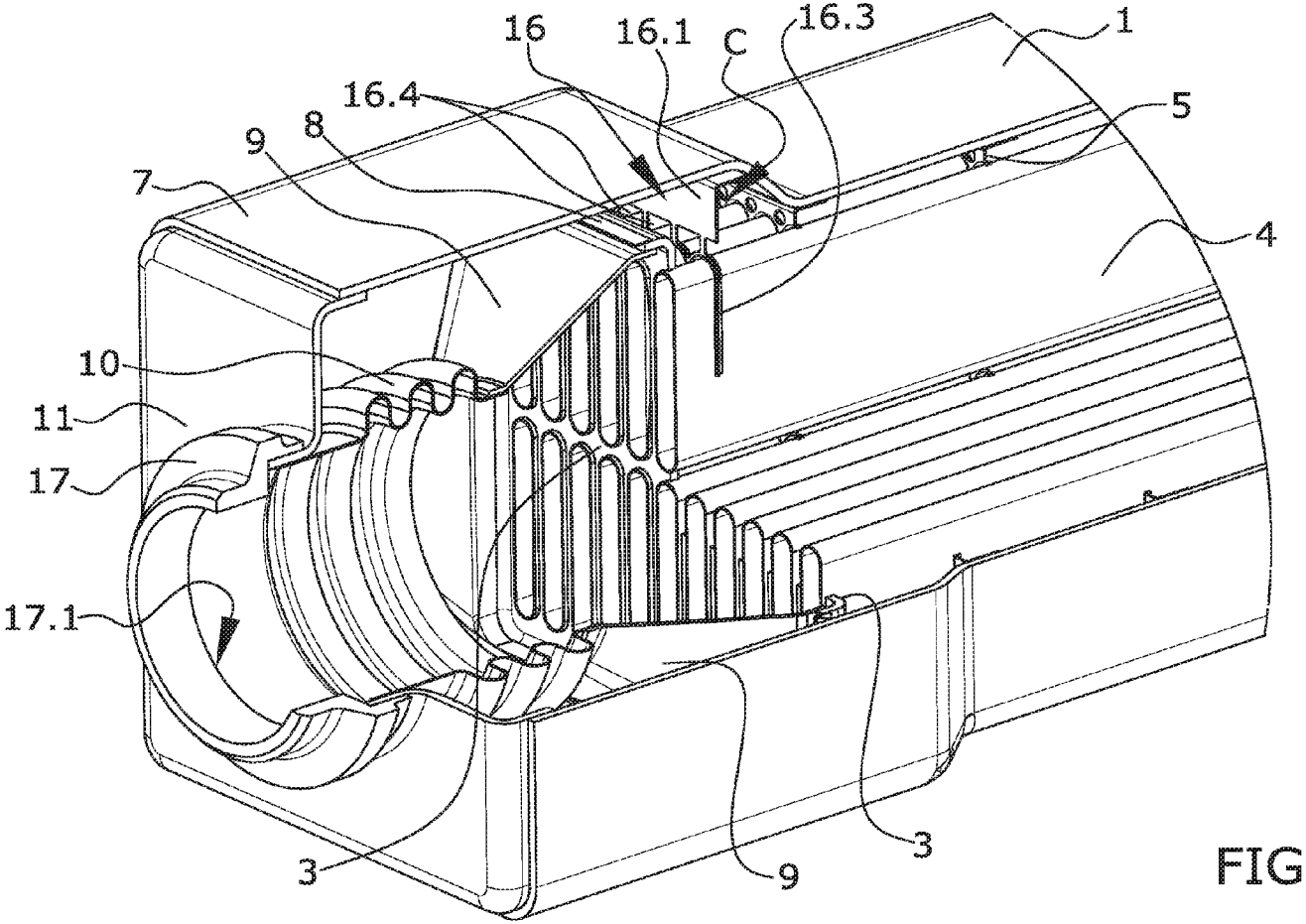
FIGS. 6 and 7 show two perspective views of another embodiment wherein a comb-shaped deflector is located near the second baffle in combination with the deflector, and the selected views are a perspective quarter-section view of the segment having a length corresponding to the chamber where the segment having a larger section of the shell is located.
Figure 7:
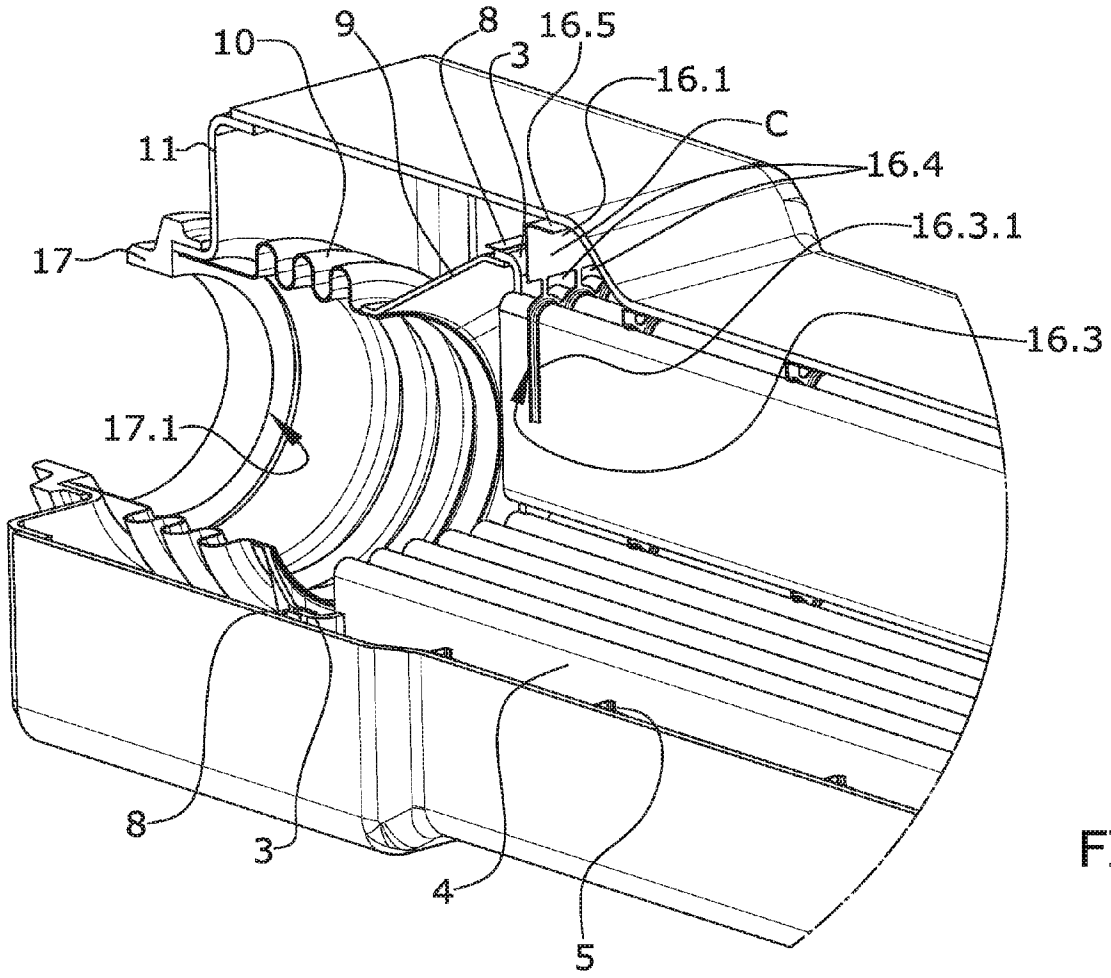

FIGS. 6 and 7 show another embodiment of the disclosure herein. The shell segment (7) having a larger section has been obtained by deep-drawing the same plate of the main longitudinal segment of the shell (1) housing the bundle of tubes (4), thus generating a step between both segments (1, 7). In this particular embodiment, the shell (1) housing the bundle of tubes (4) comprises two pieces with a "U" section according to a cross section being joined together along two longitudinal welded lines.

As it has been disclosed before, according to the disclosure herein the flow is forced to only pass through one of the sides of the deflector (8), making this preferred direction cause streamlines to run parallel to the second baffle (3), preventing stagnation regions.

Even if this change in the velocity field of the coolant flow has been verified by numerical CFD simulations both under co-current and counter-current flow, the effect is more relevant in counter-current flow as the flow of the coolant, when flowing within the bundle of tubes (4), tends to keep the longitudinal direction X-X' due to inertial forces. The streamlines are not deviated from the longitudinal direction until the flow is very close to the second baffle (3) and then is redirected, flowing parallel to the second baffle (3).

On the contrary, the co-current flow shows a flow coming from the chamber (C) trying to flow according to the pressure gradient within the bundle of tubes (4); therefore, as soon as the flow enters into the space located within the bundle of tubes (4) it is oriented towards the fixed part of the heat exchanger preventing it to flow parallel to the second baffle (3) and then reducing the effect of the deflector (8).

According to the embodiment shown in FIGS. 6 and 7, a comb-shaped deflector (16) is located, according to the longitudinal direction X-X', in the chamber (C).

Figure 8:
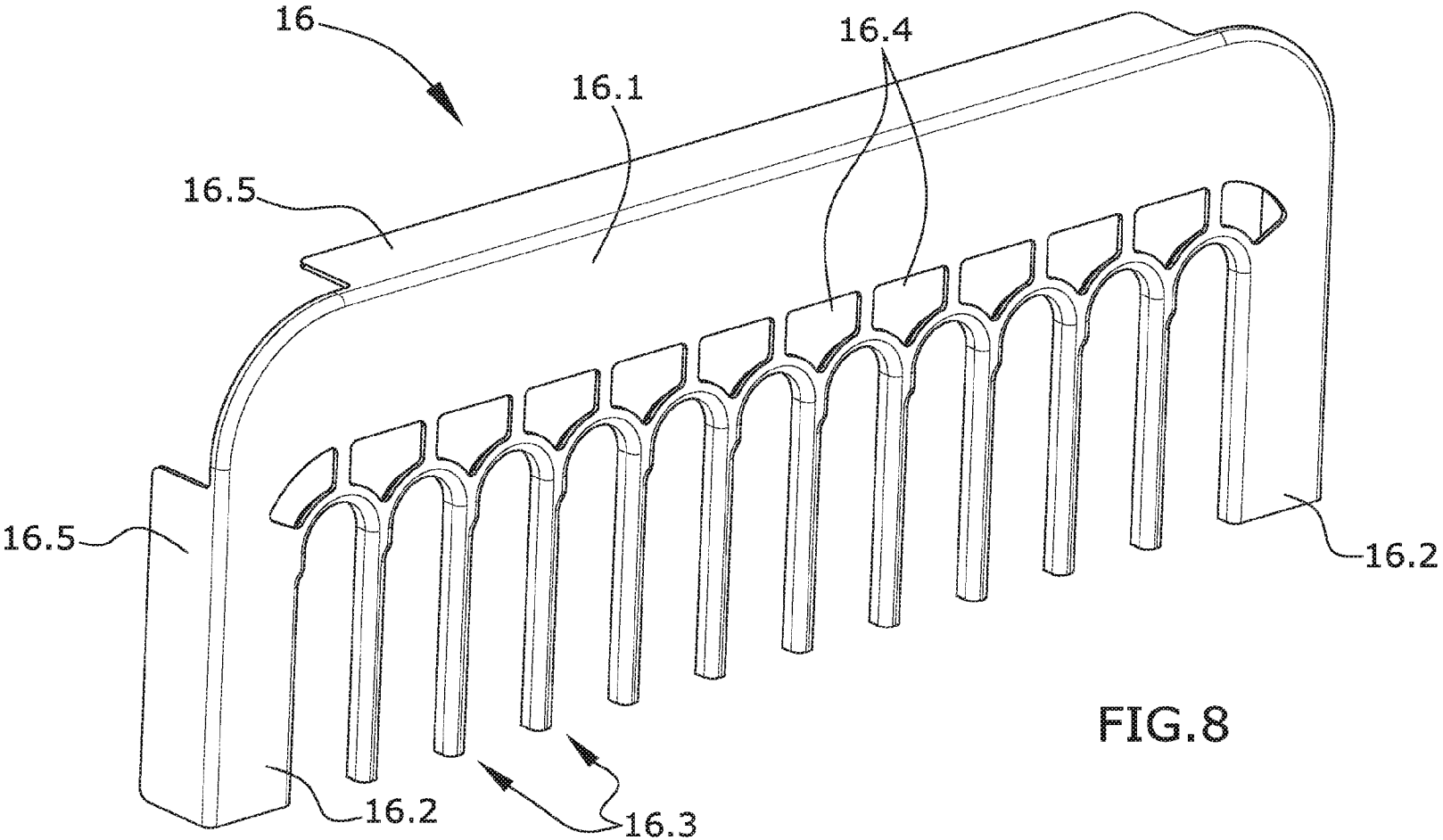
FIGS. 8 and 9 are the front and the back views of the comb-shaped deflector used in the previous embodiment.
Figure 9:
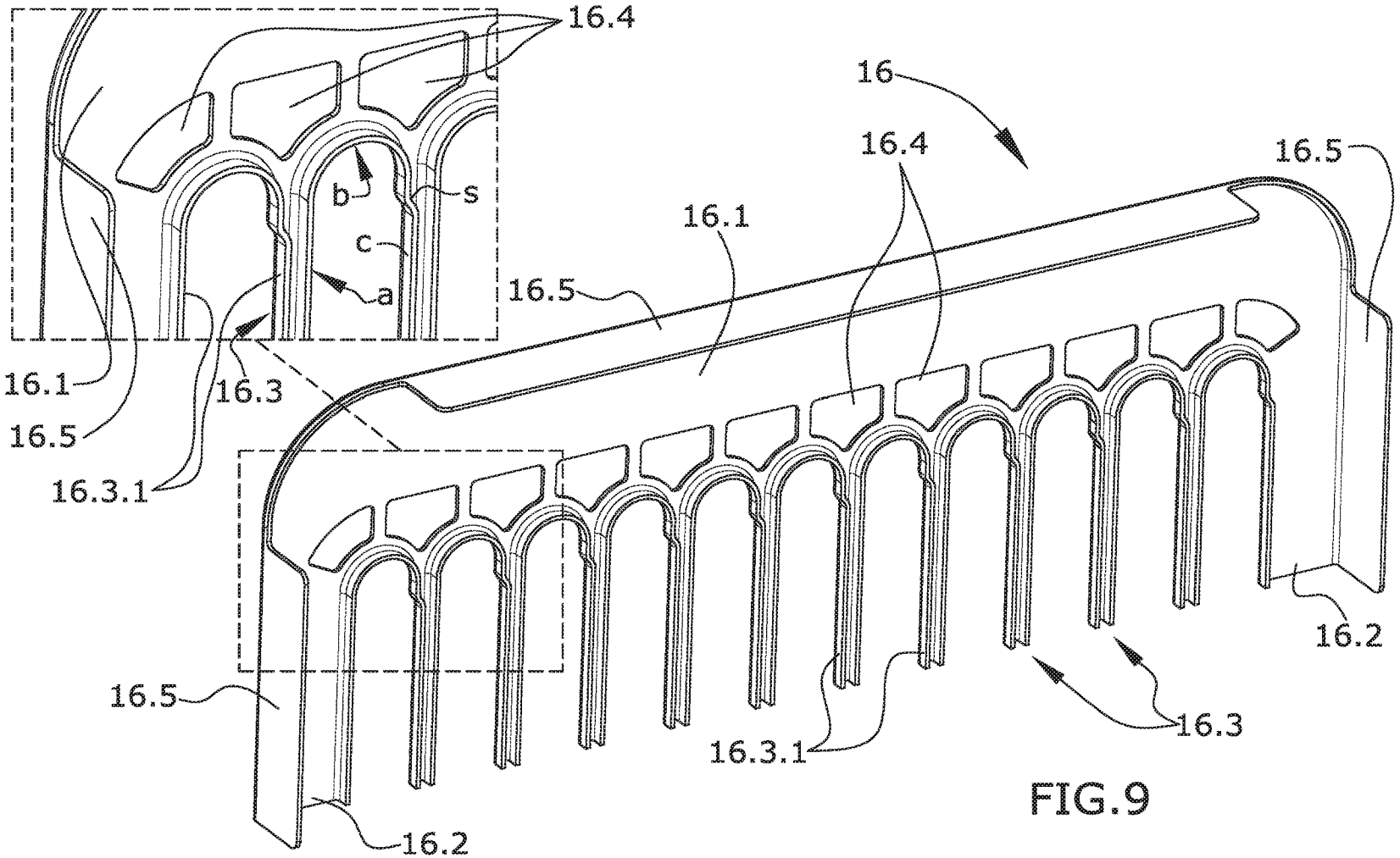

As FIGS. 8 and 9 show, the comb-shaped deflector (16) comprises a transversal body (16.1) and a plurality of parallel projections (16.3) departing from the transversal body (16.1). The parallel projections (16.3) are extended between two lateral plates (16.2). The lateral plates (16.2) and the transversal body (16.1) shows one or more supports (16.5) configured by bending the plate in a perpendicular direction.

The comb-shaped deflector (16) is partially housed among the tubes of the bundle of tubes (4). The transversal body (16.1) is housed between the bundle of tubes (4) and the shell segment (7) having a larger section, oriented transversal to the longitudinal direction X-X'.

The parallel projections (16.3) are inserted into the space between tubes of the bundle of tubes (4) and parallel to the second floating baffle (3), being the parallel projections (16.3) separated from the second floating baffle (3).

The comb-shaped deflector (16) comprises at least one support (16.5) in the transversal body (16.1), in the lateral plates (16.2) or in both. The comb-shaped deflector (16) is fixed, for instance by brazing, or by fixing the supports (16.5) to the internal wall of the chamber (C), or by fixing the parallel projections (16.3) to the bundle of tubes (4). In the embodiments shown in FIGS. 6 and 7 the supports (16.5) are fixed to the internal wall of the chamber (C) while the parallel projections (16.3) are not; these parallel projections (16.3) are just abutting the tubes of the bundle of tubes (4) allowing the bundle of tubes (4) to expand when heated by the hot gas.

The comb-shaped deflector (16) shows a further seat surface (16.3.1) in the parallel projections (16.3), in this embodiment by bending the plate, allowing the comb-shaped deflector (16) to rest on the surface of the bundle of tubes (4), at least in a portion of the seat surface (16.3.1).

The seat surface (16.3.1) has at least a first straight portion (a) abutting one flat face of a heat exchanger tube, a second arched portion (b) abutting the curved side of the heat exchanger tube; and, a third straight portion (c) parallel to the opposite flat face of the heat exchanger tube.

In this embodiment, between the second arched portion (b) and the third straight portion (c) there is a transition straight portion reaching a step (s), this step (s) defining the separation between the parallel projection (16.3) and the flat face of the heat exchanger tube. The separation between the opposite flat side of the heat exchanger tube and the third straight portion (c) allows the flow sweeping any stagnation region of the flow located adjacent to the parallel projections (16.3) of the comb-shaped deflector (16). In this embodiment, the step (s) is a curved step.

In one embodiment, not shown in the figures, the seat surface (16.3.1) is obtained by using a thicker plate provided with an edge wide enough for allowing a seat surface (16.3.1) with a resting surface rather than using a bended portion of the plate.

In one embodiment, not shown in figures, the third straight portion (c) is also abutting the opposite flat face of the heat exchanger tube allowing to deflect the whole flow of the surrounding region.

The comb-shaped deflector (16) further comprises a plurality of windows (16.4) adjacent to the seat surfaces (16.3.1) allowing the flow to pass through, preventing stagnation regions generated by the main surface of the transversal body (16.1). As FIGS. 6-9 show, in this embodiment the plurality of windows (16.4) are located out of the bundle of tubes (4), next to the space between heat exchanger tubes; that is, each window (16.4) is located in correspondence with each space between two flat heat exchanger tubes.

By running CFD simulations of the heat exchange device with co-current flow, the comb-shaped deflector (16) has been observed to force the coolant to flow parallel to the second floating baffle (3) almost on the entire surface of the second floating baffle (3) preventing the generation of stagnation regions even under co-current flow conditions.

It is important to insert the transversal body of the comb-shaped deflector (16) in the side of the rectangular section of the bundle of tubes (4) corresponding to the side where the window (8.3) of the deflector (8) is located in order to modify the flow coming from the window (8.3).

The embodiment shown in FIGS. 6 and 7 avoids the use of the intake deflector (12). Alternatively, the inlet has a connecting piece (17) as an interface between a connecting tube (not shown) and the third baffle (11). This connecting piece (17) has two different sections in the hole allowing the flow to pass through, a small section in the outer part of the hole and a large section in the inner part of the hole, both different sections separated by a step (17.1).

The shape of the connecting piece (17) located at the inlet causes a hot gas jet with a diameter smaller that the large section; therefore, the hot gas at the inlet does not impinge directly over the inner wall of the internal conduit protecting it against high temperatures.

The invention claimed is:

1. A heat exchange device adapted for cooling a hot gas by a coolant liquid, comprising:

a bundle of heat exchange tubes extending in a longitudinal direction of the device between a first fixed baffle and a second floating baffle for passage of the hot gas to be cooled; and a shell housing the bundle such that a space between the shell and the bundle allows passage of the coolant liquid, where:

the shell is closed at one end by the first fixed baffle and comprises at an opposite end a chamber formed by an extension of a shell segment having a larger section closed with a third baffle; and a first coolant liquid inlet/outlet is located at a point of the shell on a side of the first baffle and a second coolant liquid inlet/outlet is established in the shell segment having a larger section, wherein the second floating baffle has a manifold in a first fluid connection with inlets of the heat exchange tubes, and the manifold is in a second fluid connection with an inlet for the hot gas arranged in the third baffle, where the second fluid connection is by a conduit that is elastically deformable in at least the longitudinal direction;

wherein an assembly of the second floating baffle and the manifold is housed in the chamber formed by the extension of the shell segment and is separated from the shell segment along a perimeter of the assembly to allow passage of the coolant liquid; and the second coolant liquid inlet/outlet is located longitudinally between the assembly and the third baffle, and wherein, in a perimetral separation space between the assembly and the shell segment having a larger section, there is a deflector closing the separation space along at least a portion of the separation space, and wherein the deflector comprises a perimetral band, which is supported on a surface of the second floating baffle.

2. The device according to claim 1, wherein the assembly formed by the second floating baffle and the manifold has an essentially rectangular perimetral shape, and wherein the deflector covers at least three sides thereof.

3. The device according to claim 1, wherein the elastically deformable conduit has a bellows configuration.

4. The device according to claim 1, wherein the hot gas inlet has an intake deflector formed by a tubular segment that extends inside the elastically deformable conduit for directing hot gas flow towards a central longitudinal axis thereof, protecting the elastically deformable conduit from heat.

5. The device according to claim 4, wherein the third baffle is configured as a fixing flange of the heat exchange device, and wherein the intake deflector has a perimetral rib on an outer face of the third baffle for establishing a pressure-type seat after attachment of the flange.

6. The device according to claim 1, wherein the hot gas inlet has a connecting piece comprising an outer small section and an inner large section for protecting inner walls of the elastically deformable conduit against high temperatures.

7. The device according to claim 1, wherein the second coolant liquid inlet/outlet is established along a groove located between a free edge of the shell segment having a larger section and the third baffle.

8. The device according to claim 7, wherein the manifold comprises a plate extending externally from the shell segment having a larger section to the third baffle internally housing the groove, and arranging the second coolant liquid inlet/outlet in the plate.

9. The device according to claim 1, wherein the bundle has one or more support baffles, which are either:

conjoint with the shell without restricting longitudinal movement of the bundle of heat exchange tubes passing therethrough; or conjoint with the bundle of heat exchange tubes passing therethrough without restricting longitudinal movement with respect to the shell.

10. The device according to claim 1, wherein the shell housing the bundle extends in the longitudinal direction in part or in the entire perimeter thereof, entering at least a part of the chamber to increase coolant liquid velocity in the chamber.

11. The device according to claim 1, further comprising a comb-shaped deflector in the chamber, the comb-shaped deflector comprising a transversal body and a plurality of parallel projections departing from the transversal body; wherein:

the transversal body is housed between the bundle of tubes and the shell segment having a larger section, oriented transversal to the longitudinal direction; and the plurality of parallel projections are inserted into the space between tubes of the bundle of tubes and parallel to the second floating baffle.

12. The device according to claim 11, wherein the comb-shaped deflector further comprises two lateral plates such that the plurality of parallel projections departing from the transversal body are located between the lateral plates; and wherein the lateral plates are extended in both sides of the bundle of tubes, between the bundle of tubes and the shell segment having a larger section.

13. The device according to claim 10, wherein the comb-shaped deflector comprises at least one support in the transversal body, in at least one of the lateral plates or in both.

14. The device according to claim 13, wherein the comb-shaped deflector is fixed either by fixing the supports to the internal wall of the chamber, or alternatively by fixing the parallel projections to the bundle of tubes.

15. The device according to claim 10, wherein the parallel projections have a seat surface configured for abutting on the surface of the heat exchanger tubes; and wherein at least one of the parallel projections has a portion of the seat surface with a recess, distanced from the surface of the heat exchanger, allowing the flow to pass-through for avoiding stagnation regions.

16. The device according to claim 1, wherein the device is configured for use in an Exhaust Gas Recirculation (EGR) system for internal combustion vehicles.

* * * * *